US010872712B2

(12) United States Patent
Kaga et al.

(10) Patent No.: US 10,872,712 B2
(45) Date of Patent: Dec. 22, 2020

(54) INSULATED WIRE

(71) Applicant: Hitachi Metals, Ltd., Tokyo (JP)

(72) Inventors: Masafumi Kaga, Tokyo (JP); Tamotsu Kibe, Tokyo (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 16/175,019

(22) Filed: Oct. 30, 2018

(65) Prior Publication Data

US 2019/0139677 A1 May 9, 2019

(30) Foreign Application Priority Data

Nov. 7, 2017 (JP) ..... 2017-214558

(51) Int. Cl.

| | |
|---|---|
| ***H01B 7/295*** | (2006.01) |
| ***H01B 7/02*** | (2006.01) |
| ***H01B 3/44*** | (2006.01) |
| *H01B 3/30* | (2006.01) |

(52) U.S. Cl.

CPC ..... *H01B 7/295* (2013.01); *H01B 3/441* (2013.01); *H01B 3/447* (2013.01); *H01B 7/0291* (2013.01); *H01B 3/307* (2013.01); *H01B 3/448* (2013.01)

(58) Field of Classification Search

CPC ..... H01B 3/447; H01B 3/448; H01B 3/301; H01B 3/305; H01B 3/423; H01B 7/292; H01B 7/295; H01B 7/0045

USPC ..... 174/110 R, 110 SR, 110 SC, 120 R, 174/120 SR; 525/285, 288, 286; 428/391

See application file for complete search history.

(56) References Cited

U.S. PATENT DOCUMENTS

| | | | |
|---|---|---|---|
| 2,437,708 | A | 3/1948 | Plass et al. |
| 2,446,387 | A | 8/1948 | Peterson |
| 2,721,154 | A | 10/1955 | Hopf et al. |
| 2,913,515 | A | 11/1959 | Ebel et al. |

(Continued)

FOREIGN PATENT DOCUMENTS

| | | | |
|---|---|---|---|
| JP | 5-47225 | A | 2/1993 |
| JP | 6-52728 | A | 2/1994 |

(Continued)

OTHER PUBLICATIONS

Japanese-language Office Action issued in counterpart Japanese Application No. 2017-214558 dated Nov. 20, 2018 (four (4) pages).

(Continued)

*Primary Examiner* — William H. Mayo, III

(74) *Attorney, Agent, or Firm* — Crowell & Moring LLP

(57) ABSTRACT

An insulated wire having an electrical wire structure capable of reducing a diameter while a direct-current stability property and a flame-retardant property are highly kept is provided. In the insulated wire including: a conductor; a flame-retardant semiconductive layer arranged on an outer periphery of the conductor; an insulating layer arranged on an outer periphery of the flame-retardant semiconductive layer; and a flame-retardant layer arranged on an outer periphery of the insulating layer, an oxygen index of the flame-retardant semiconductive layer defined by JIS K7201-2 is larger than 40, and a volume resistivity of the flame-retardant semiconductive layer defined by JIS C2151 is equal to or smaller than $5.0\times10^{15}$ (Ωcm).

13 Claims, 3 Drawing Sheets

(56) References Cited

U.S. PATENT DOCUMENTS

| | | | | |
|---|---|---|---|---|
| 3,178,384 | A | 4/1965 | Rice et al. | |
| 3,424,631 | A | 1/1969 | Peacock | |
| 3,632,720 | A | 1/1972 | Mildner | |
| 3,793,716 | A | 2/1974 | Smith-Johannsen | |
| 3,849,192 | A | 11/1974 | Schmidt | |
| 3,861,029 | A | 1/1975 | Smith-Johannsen et al. | |
| 4,124,747 | A | 11/1978 | Murer et al. | |
| 4,187,389 | A | 2/1980 | Foote et al. | |
| 4,312,383 | A | 1/1982 | Kleykamp | |
| 4,488,125 | A | 12/1984 | Gentry et al. | |
| 4,554,173 | A | 11/1985 | Fujimura et al. | |
| 4,650,972 | A | 3/1987 | Cunningham | |
| 4,769,179 | A | 9/1988 | Kato et al. | |
| 5,001,304 | A | 3/1991 | Hardin et al. | |
| 5,063,125 | A | 11/1991 | Yuh et al. | |
| 5,106,538 | A | 4/1992 | Barma et al. | |
| 5,260,848 | A | 11/1993 | Childers | |
| 5,358,786 | A * | 10/1994 | Ishikawa | H01B 3/30 174/110 AR |
| 5,459,041 | A | 10/1995 | Blaser et al. | |
| 6,034,162 | A * | 3/2000 | Mizutani | C08K 5/09 428/921 |
| 6,359,230 | B1 * | 3/2002 | Hildreth | H01B 3/441 174/110 R |
| 6,755,995 | B1 | 6/2004 | Hasegawa et al. | |
| 8,946,557 | B2 * | 2/2015 | Fukuda | H01B 3/301 174/110 AR |
| 9,443,645 | B2 | 9/2016 | Iwasaki et al. | |
| 9,514,860 | B2 | 12/2016 | Kikuchi et al. | |
| 2001/0009198 | A1 | 7/2001 | Belli et al. | |
| 2003/0141097 | A1 | 7/2003 | Belli et al. | |
| 2003/0164483 | A1 | 9/2003 | Scelza et al. | |
| 2004/0149483 | A1 | 8/2004 | Glew | |
| 2005/0045368 | A1 | 3/2005 | Keogh | |
| 2006/0096777 | A1 | 5/2006 | Glew | |
| 2007/0010615 | A1 | 1/2007 | Cogen et al. | |
| 2008/0311328 | A1 * | 12/2008 | Kimura | C08K 9/06 428/36.91 |
| 2008/0317990 | A1 * | 12/2008 | Runyan | B29C 71/04 428/36.9 |
| 2009/0200059 | A1 | 8/2009 | Cinquemani et al. | |
| 2010/0163269 | A1 | 7/2010 | Perego et al. | |
| 2011/0111153 | A1 * | 5/2011 | Russell | B32B 1/08 428/36.9 |
| 2011/0172367 | A1 * | 7/2011 | Backer | C08F 255/00 525/254 |
| 2011/0198105 | A1 | 8/2011 | Shanai et al. | |
| 2012/0227997 | A1 | 9/2012 | Koelblin | |
| 2013/0092416 | A1 | 4/2013 | Saito et al. | |
| 2013/0228358 | A1 * | 9/2013 | Fujimoto | H01B 7/292 174/110 SR |
| 2014/0011028 | A1 | 1/2014 | Iwasaki et al. | |
| 2014/0030520 | A1 * | 1/2014 | Nakamura | H01B 3/308 428/368 |
| 2014/0083738 | A1 * | 3/2014 | Segawa | H01B 7/295 174/120 C |
| 2014/0166339 | A1 | 6/2014 | Bates | |
| 2014/0182883 | A1 * | 7/2014 | Sugita | H01B 3/447 174/113 R |
| 2014/0370315 | A1 * | 12/2014 | Iwasaki | H01B 3/441 428/516 |
| 2015/0034359 | A1 * | 2/2015 | Sugita | H01B 7/295 174/107 |
| 2015/0371735 | A1 * | 12/2015 | Iwasaki | H01B 7/29 428/372 |
| 2016/0049221 | A1 | 2/2016 | Lee et al. | |
| 2016/0125973 | A1 * | 5/2016 | Iwasaki | H01B 3/448 428/383 |
| 2016/0148724 | A1 | 5/2016 | Kikuchi et al. | |
| 2017/0032867 | A1 | 2/2017 | Iwasaki et al. | |
| 2017/0365373 | A1 | 12/2017 | Hirano et al. | |
| 2017/0365378 | A1 | 12/2017 | Kaga et al. | |
| 2018/0033522 | A1 | 2/2018 | Blair et al. | |

FOREIGN PATENT DOCUMENTS

| | | | | |
|---|---|---|---|---|
| JP | 2001-1347559 | * | 12/2001 | B29C 47/40 |
| JP | 2007-168500 | A | 7/2007 | |
| JP | 2011-228189 | | 11/2011 | |
| JP | 2014-11140 | A | 1/2014 | |
| JP | 2014-225478 | | 12/2014 | |
| JP | 2015-74730 | A | 4/2015 | |
| JP | 2015-118857 | A | 6/2015 | |
| JP | 2015118857 | A * | 6/2015 | H01B 7/02 |
| JP | 2017-27878 | A | 2/2017 | |
| KR | 10-0855795 | A * | 8/2008 | C08L 23/06 |

OTHER PUBLICATIONS

Japanese-language Office Action issued in counterpart Japanese Application No. 2017-214346 dated Nov. 22, 2018 (three (3) pages).

Japanese-language Office Action issued in counterpart Japanese Application No. 2017-214559 dated Nov. 20, 2018 (three (3) pages).

Non-Final U.S. Office Action issued in U.S. Appl. No. 16/174,996 dated Mar. 28, 2019 (14 pages).

"Common Test Methods for Cables Under Fire Conditions—Test for Vertical Flame Spread of Vertically-Mounted Bunched Wires or Cables", British Standard, EN 50266-2-4:2001 (14 pages).

"Railway Applications—Railway Rolling Stock Cables Having Special Fire Performance—Test Methods", British Standard, EN 50305:2002 (42 pages).

"Testing Methods of Plastic Films for Electrical Purposes" JIS C2151, Aug. 20, 2006, Japanese Standards Association, with partial English translation (57 pages).

"Plastics—Determination of Burning Behavior by Oxygen Index—Part 2: Ambient-Temperature Test", JIS K7201-2, Mar. 20, 2007, Japanese Standards Association, with partial English translation (40 pages).

Japanese-language Office Action issued in counterpart Japanese Application No. 2017-214559 dated Feb. 5, 2019 with English translation (seven (7) pages).

Japanese-language Office Action issued in counterpart Japanese Application No. 2017-214558 dated Feb. 5, 2019 with English translation (seven (7) pages).

Japanese-language Office Action issued in counterpart Japanese Application No. 2017-214346 dated Feb. 1, 2019 with English translation (six (6) pages).

U.S. Appl. No. 16/174,996, filed Oct. 30, 2018.

U.S. Appl. No. 16/175,127, filed Oct. 30, 2018.

Final U.S. Office Action issued in U.S. Appl. No. 16/174,996 dated Oct. 3, 2019 (10 pages).

Non-Final U.S. Office Action issued in U.S. Appl. No. 16/174,996 dated Feb. 24, 2020 (13 pages).

Japanese-language Office Action issued in Japanese Application No. 2017-214558 dated Mar. 26, 2020 with English translation (12 pages).

Japanese-language Office Action issued in Japanese Application No. 2017-214346 dated Mar. 26, 2020 with English translation (nine (9) pages).

Japanese-language Office Action issued in Japanese Application No. 2017-214559 dated Mar. 26, 2020 with English translation (12 pages).

Final U.S. Office Action issued in U.S. Appl. No. 16/174,996 dated Sep. 18, 2020 (12 pages).

Non-Final U.S. Office Action issued in U.S. Appl. No. 16/175,127 dated Dec. 10, 2019 (24 pages).

* cited by examiner

INSULATED WIRE

CROSS-REFERENCE TO RELATED APPLICATION

The present application claims priority from Japanese Patent Application No. 2017-214558 filed on Nov. 7, 2017, the content of which is hereby incorporated by reference into this application.

TECHNICAL FIELD OF THE INVENTION

The present invention relates to an insulated wire.

BACKGROUND OF THE INVENTION

Insulated wires, which are used as wiring in railroad cars and automobiles, are required to have not only the insulation property but also such a flame-retardant property as making the wires difficult to burn at the time of fire. For this reason, anon-halogen filler is contained in a coating layer of the insulated wire. For example, Japanese Patent Application Laid-Open Publication No. 2014-11140 (Patent Document 1) discloses an insulated wire having a coating layer formed by stacking a flame-retardant layer containing a non-halogen filler on an outer periphery of an insulating layer having an insulation property. According to the Patent Document 1, the insulation property and the flame-retardant property can be well balanced at a high level.

SUMMARY OF THE INVENTION

Meanwhile, in recent years, reducing an outer diameter of the insulated wire has been required for a purpose of reducing a weight of the insulated wire. Therefore, reducing thicknesses of an inner-positioned insulating layer and an outer-positioned flame-retardant layer has been studied.

Accordingly, an object of the present invention is to provide an insulated wire capable of achieving diameter reduction while the insulation property and the flame-retardant property are kept.

The present invention provides the following insulated wires.

[1] The insulated wire includes: a conductor; a flame-retardant semiconductive layer arranged on an outer periphery of the conductor; an insulating layer arranged on an outer periphery of the flame-retardant semiconductive layer; and a flame-retardant layer arranged on an outer periphery of the insulating layer, an oxygen index of the flame-retardant semiconductive layer defined by JIS K7201-2 is larger than 40, and a volume resistivity of the flame-retardant semiconductive layer defined by JIS C2151 is equal to or smaller than $5.0\times10^{15}$ (Ωcm).

[2] In the insulated wire described in aspect [1], a diameter of the conductor is equal to or smaller than 1.25 mm, and a total of the thicknesses of the flame-retardant semiconductive layer, the insulating layer, and the flame-retardant layer is smaller than 0.6 mm.

[3] In the insulated wire described in the aspect [1] or [2], a diameter of the conductor is larger than 1.25 mm and equal to or smaller than 5.0 mm, and a total of the thicknesses of the flame-retardant semiconductive layer, the insulating layer, and the flame-retardant layer is smaller than 0.7 mm.

[4] In the insulated wire described in any one of the aspects [1] to [3], the insulated wire has a flame-retardant property that allows the insulated wire to pass a vertical tray flame test (VTFT) on the basis of EN 50266-2-4.

[5] In the insulated wire described in any one of the aspects [1] to [4], the insulated wire has a direct-current stability that allows the insulated wire to pass a direct-current stability test in conformity to EN 50305.6.7.

[6] In the insulated wire described in any one of aspects [1] to [5], a volume resistivity of the insulating layer defined by JIS C2151 is larger than $1.0\times10^{16}$ (Ωcm).

[7] In the insulated wire described in any one of aspects [1] to [6], an oxygen index of the flame-retardant layer is larger than 40.

[8] In the insulated wire described in any one of aspects [1] to [7], the flame-retardant semiconductive layer includes at least one resin selected from a group consisting of high-density polyethylene, linear low-density polyethylene, low-density polyethylene, ethylene-(α-olefin) copolymer, ethylene-vinyl acetate copolymer, ethylene-acrylic acid ester copolymer, and ethylene-propylene-diene copolymer.

[9] In the insulated wire described in any one of aspects [1] to [8], the flame-retardant layer includes at least one resin selected from a group consisting of high-density polyethylene, linear low-density polyethylene, low-density polyethylene, ethylene-(α-olefin) copolymer, ethylene-vinyl acetate copolymer, ethylene-acrylic acid ester copolymer, and ethylene-propylene-diene copolymer.

[10] In the insulated wire described in any one of aspects [1] to [9], the flame-retardant semiconductive layer contains a resin component and a non-halogen filler so that 150 or more and 250 or less parts by mass of the non-halogen filler per 100 parts by mass of the resin component is contained.

[11] In the insulated wire described in any one of aspects [1] to [10], at least a part of the insulating layer is a cross-linked substance.

[12] In the insulated wire described in any one of aspects [1] to [11], a resin composition making up the insulating layer contains a resin component, and the resin component is made of high-density polyethylene and/or low-density polyethylene.

According to the present invention, an insulated wire having a wire structure capable of achieving diameter reduction while the direct-current stability property and the flame-retardant property are kept high can be provided.

BRIEF DESCRIPTIONS OF THE DRAWINGS

DESCRIPTIONS OF THE PREFERRED EMBODIMENTS

Figure 3:
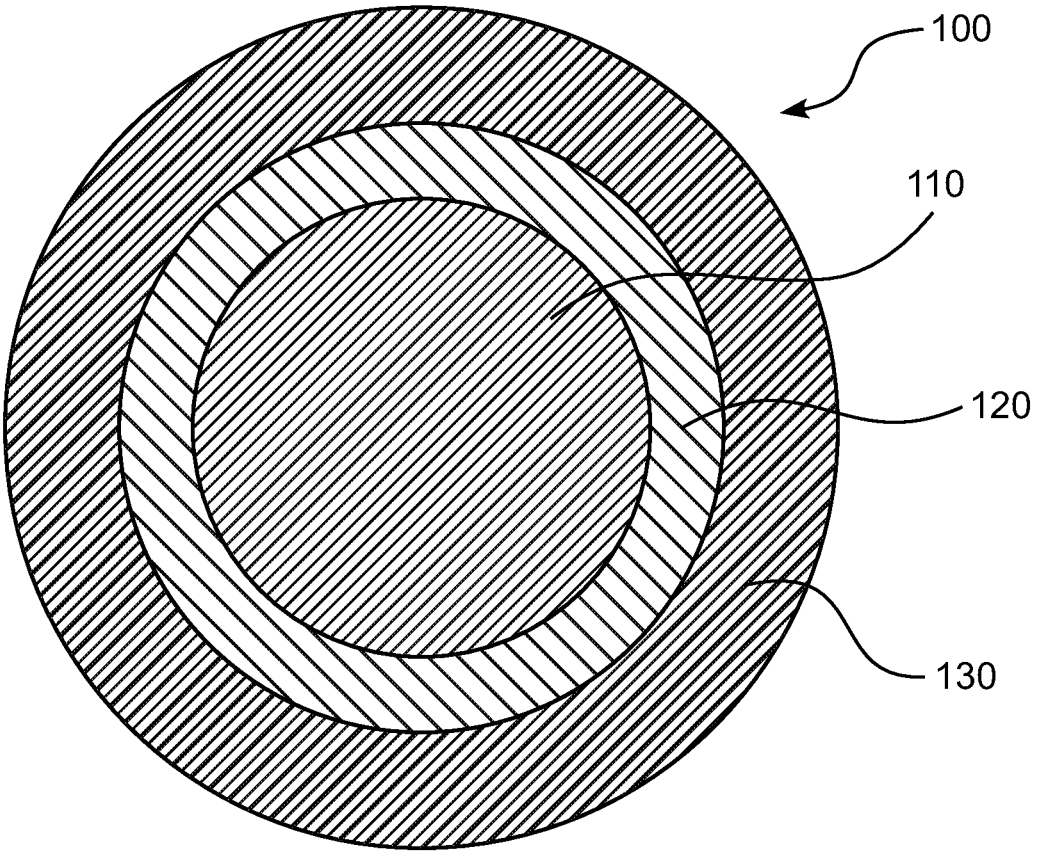
FIG. 3 is a horizontal cross-sectional view showing a related-art insulated wire.

First, the related-art insulated wire will be described with reference to FIG. 3. FIG. 3 is a cross-sectional view of the related-art insulated wire that is vertical to a longitudinal direction.

As shown in FIG. 3, a related-art insulated wire 100 includes a conductor 110, an insulating layer 120 arranged on an outer periphery of the conductor 110, and aflame-retardant layer 130 which is arranged on an outer periphery of the insulating layer 120 and mixed with a non-halogen filler.

In the related-art insulated wire 100, the flame-retardant layer 130 is made of a resin as similar to the insulating layer 120, and therefore, exhibits a predetermined insulation property, but has low insulation reliability, and does not contribute to the direct-current stability in many cases. As described later, the direct-current stability is one of electrical characteristics evaluated by a direct-current stability test in conformity to EN 50305.6.7. The direct-current stability shows that a breakdown does not occur in the insulated wire even after an elapse of a predetermined time in immersion of the insulated wire 100 into salt solution with application of a predetermined voltage, and becomes an index of the insulation reliability.

According to the study made by the present inventors, it has been found out that the reason why the flame-retardant layer 130 does not contribute to the direct-current stability is that a volume resistivity is low because of the mixture of the non-halogen filler. As one of causes for this, in the flame-retardant layer 130, it is considered that small gaps are undesirably formed around the non-halogen filler because of low adherence between the resin and the non-halogen filler which make up the flame-retardant layer 130. Because of these gaps, moisture easily infiltrates and is absorbed into the flame-retardant layer 130. In such a flame-retardant layer 130, when the insulated wire 100 is immersed into water to evaluate its direct-current stability, a conductive path is formed because of the infiltration of the moisture to easily cause the breakdown. Therefore, there is the tendency of the low insulation reliability. In this manner, the flame-retardant layer 130 tends to have the low insulation property because of the water absorption, and consequently does not contribute to the direct-current stability.

On the other hand, the insulating layer 120 is coated with the flame-retardant layer 130, and therefore, does not need to be mixed with the non-halogen filler. For this reason, although the insulating layer 120 does not exhibit the flame-retardant property as observed in the flame-retardant layer 130, the insulating layer 120 is configured so as to have a high volume resistivity, and therefore, contributes to the direct-current stability.

In this manner, in the related-art insulated wire 100, the insulating layer 120 contributes to the direct-current stability while the flame-retardant layer 130 contributes to the flame-retardant property. Therefore, in order to achieve both the direct-current stability and the flame-retardant property at high levels, it is required to thicken each of the insulating layer 120 and the flame-retardant layer 130, and therefore, it is difficult to thin each of them in the purpose of reducing the diameter of the insulated wire 100.

In this manner, according to the related-art insulated wire 100, the direct-current stability is ensured while the flame retardant property is ensured by forming the insulating layer 120 on the outer periphery of the conductor 110 and forming the flame-retardant layer 130 on the outermost layer. Meanwhile, the present inventors have found that the direct-current stability is significantly improved without decreasing the flame-retardant property by further adding a flame-retardant semiconductive layer onto the outer periphery of the conductor.

That is, the present inventors have found that, when a conductive material having a volume resistivity equal to or smaller than $5.0\times10^{15}$ (Ωcm) that is smaller than that of the insulating layer is used inside the insulating layer, the direct-current stability is increased, and found that the high flame-retardant property can be also achieved when the conductive material is a conductive material having an oxygen index that is larger than 40 as the flame-retardant property.

However, the insulating layer practically contains no flame retardant, and therefore, is poor in the flame-retardant property. Therefore, when such an insulating layer is formed on the surface of the insulated wire, there is a risk of reduction in the flame-retardant property of the entire insulated wire.

Regarding this, the flame-retardant property is kept high by forming the insulating layer with the poor flame-retardant property between flame-retardant layers to form, for example, an insulated wire having three layers that are the flame-retardant semiconductive layer, the insulating layer, and the flame-retardant layer (which may hereinafter be collectively referred to as "coating layer") in this order from the conductor side, and besides, the direct-current stability is kept high by suppressing the water infiltration into the flame-retardant semiconductive layer by using the insulating layer, and the diameter can be reduced. When a plurality of such insulated wires whose diameters can be reduced are bundled together and used as a wire harness, such a further effect as a reduction in the weight of the wire harness is caused.

In addition, by forming the flame-retardant layer so that its oxygen index that is a flame-retardant index is larger than 40, the desired high flame-retardant property of the coating layer can be kept while each flame-retardant layer is further thinned.

In the present specification, note that "the diameter reduction" means that the outer diameter of the insulated wire is reduced by thinning the coating layer of the insulated wire so as to be thinner than that of the related-art insulated wire (Table 1—General data—Cable type 0.6/1 kV unsheathed of EN 50264-3-1 (2008)) having the same conductor diameter.

Specifically, when the conductor diameter is equal to or smaller than 1.25 mm, the thickness of the coasting layer of the insulated wire can be smaller than 0.60 mm. When the conductor diameter is larger than 1.25 mm and equal to or smaller than 5.00 mm, the thickness of the coasting layer of the insulated wire can be smaller than 0.70 mm. When the conductor diameter is larger than 5.00 mm and equal to or smaller than 7.70 mm, the thickness of the coasting layer of the insulated wire can be smaller than 0.90 mm. When the conductor diameter is larger than 7.7 mm and equal to or smaller than 9.20 mm, the thickness of the coasting layer of the insulated wire can be smaller than 1.00 mm. When the conductor diameter is larger than 9.20 mm and equal to or smaller than 12.50 mm, the thickness of the coasting layer of the insulated wire can be smaller than 1.10 mm. When the conductor diameter is larger than 12.50 mm and equal to or smaller than 14.20 mm, the thickness of the coasting layer of the insulated wire can be smaller than 1.20 mm. When the conductor diameter is larger than 14.20 mm and equal to or smaller than 15.80 mm, the thickness of the coasting layer of the insulated wire can be smaller than 1.40 mm. When the conductor diameter is larger than 15.80 mm and equal to or smaller than 17.50 mm, the thickness of the coasting layer of the insulated wire can be smaller than 1.60 mm. When the conductor diameter is larger than 17.50 mm and equal to or smaller than 20.10 mm, the thickness of the coasting layer of the insulated wire can be smaller than 1.70 mm. When the conductor diameter is larger than 20.10 mm and equal to or smaller than 22.50 mm, the thickness of the coasting layer of the insulated wire can be smaller than 1.80 mm. When the conductor diameter is larger than 22.50 mm and equal to or smaller than 25.80 mm, the thickness of the coasting layer of the insulated wire can be smaller than 2.00 mm.

In addition, a mechanical strength has been evaluated on the basis of the standard EN 50264, 60811-1-2, and the breaking elongation can be equal to or larger than 150%.

The present invention has been made on the basis of the above-described findings.

Next, an aspect of the present invention will be described with reference to FIG. 1.

<Configuration of Insulated Wire>

Figure 1:
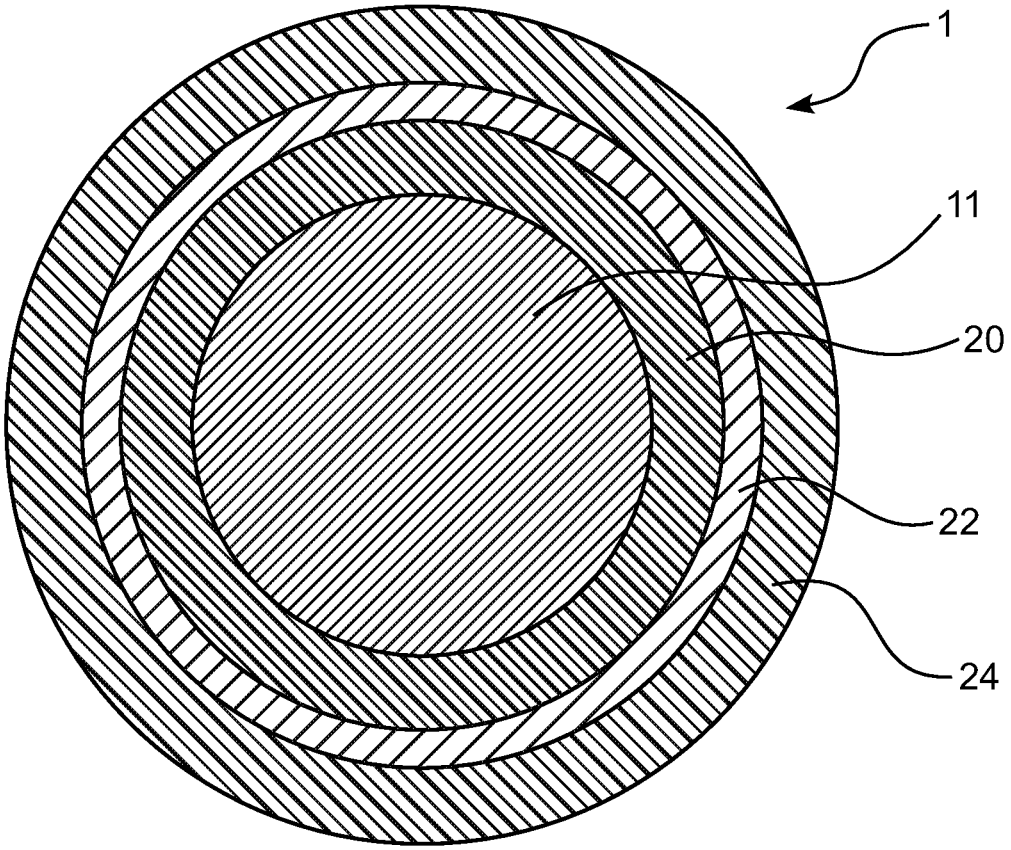
FIG. 1 is a horizontal cross-sectional view showing an embodiment of an insulated wire of the present invention.

FIG. 1 is a cross-sectional view that is vertical to a longitudinal direction of the insulated wire according to the embodiment of the present invention. As shown in FIG. 1, the insulated wire 1 according to the present embodiment includes a conductor 11, a flame-retardant semiconductive layer 20 on an outer periphery of the conductor 11, an insulating layer 22 on an outer periphery of the flame-retardant semiconductive layer 20, and a flame-retardant layer 24 on an outer periphery of the insulating layer 22.

(Conductor)

As the conductor 11, not only a normally-used metal wire such as a copper wire or a copper alloy wire but also an aluminum wire, a gold wire, and a silver wire can be used. A metal wire whose outer periphery is metal-plated with tin, nickel or others may be used. Further, a bunch stranded conductor formed by strand metal wires can be also used. A cross-sectional area and an outer diameter of the conductor 11 can be properly changed in accordance with the electrical characteristics required for the insulated wire 1. For example, the cross-sectional area is exemplified to be equal to or larger than 1 $mm^2$ and equal to or smaller than 10 $mm^2$, and the outer diameter is exemplified to be equal to or larger than 1.20 mm and equal to or smaller than 2.30 mm.

(Flame-Retardant Semiconductive Layer)

The flame-retardant semiconductive layer 20 is formed by, for example, extruding a material containing a metal hydroxide onto the outer periphery of the conductor 11. In the present embodiment, the flame-retardant semiconductive layer 20 is formed so that its volume resistivity is equal to or smaller than $5.0\times10^{15}$ (Ωcm) and its oxygen index is larger than 40.

The oxygen index of the flame-retardant semiconductive layer 20 is not particularly limited to a specific value as long as it is larger than 40, and the larger is more preferable in terms of the flame-retardant property. Note that the oxygen index is an index of the flame-retardant property, and is defined by JIS K7201-2 in the present embodiment.

The volume resistivity of the flame-retardant semiconductive layer 20 is not particularly limited to a specific value as long as it is equal to or smaller than $5.0\times10^{15}$ (Ωcm), and the smaller is more preferable in terms of the conductivity. Note that the volume resistivity is an index of the conductivity, and is defined by JIS C2151 in the present embodiment.

The flame-retardant semiconductive layer 20 is made of a flame-retardant conductive resin composition containing a resin component, and contains a conductive filler and/or a flame-retardant filler when necessary.

A type of the resin component making up the flame-retardant semiconductive layer 20 may be properly changed in accordance with the characteristics required for the insulated wire 1, such as elongation and strength. For example, a vinyl chloride resin, fluororesin, polyolefin resin such as polyethylene, polyimide, polyether ether ketone (PEEK), etc., can be used.

As the examples of the vinyl chloride resin, a single polymer of vinyl chloride (polyvinyl chloride), copolymer of vinyl chloride and other monomer that can copolymerize (e.g., vinyl chloride-vinyl acetate copolymer), and a mixture of these substances are cited. When necessary, two or more types of vinyl chloride resins that are different in a degree of polymerization may be mixed in combination and used.

As the examples of the fluororesin, tetrafluoroethylene-perfluoroalkylvinylether copolymer (PFA), tetrafluoroethylene-hexafluoropropylene copolymer (FEP), polytetrafluoroethylene (PTFE), ethylene-tetrafluoroethylene copolymer (EFEP), ethylene-tetrafluoroethylene copolymer (ETFE) and others can be used. One type or combination of these substances may be used. Note that at least a part of the fluororesin is preferable to be cross-linked.

As the polyolefin-based resin, a polyethylene-based resin, a polypropylene-based resin, etc., can be used, and the polyethylene-based resin is particularly preferable. As the polyethylene-based resin, for example, linear low-density polyethylene (LLDPE), low-density polyethylene (LDPE), high-density polyethylene (HDPE), ethylene-(α-olefin) copolymer, ethylene-vinyl acetate copolymer (EVA), ethylene-acrylic acid ester copolymer, and ethylene-propylene-diene copolymer, etc., can be used. Out of these resins, a single resin may be used, or two or more types of the resins may be used together. From the viewpoint of obtaining the higher flame-retardant property in the flame-retardant semiconductive layer 20, EVA is particularly preferable among the polyolefin-based resins.

When a polymer with the high flame-retardant property is used, addition of the flame retardant is optional. When a polyolefin resin is used, it is preferable to add a large amount of a flame-retardant filler in order to increase the oxygen index of the flame-retardant semiconductive layer 20. When polyimide or PEEK is used, it is not required to add the flame-retardant filler because each of these materials has the high flame-retardant property of the resin itself. The polyolefin has a lower forming temperature than that of the polyimide, etc., so that the formability of the flame-retardant semiconductive layer 20 is superior thereto, and besides, has a larger breaking elongation than that of the polyimide, etc., so that bendability of the flame-retardant semiconductive layer 20 is superior thereto.

As the flame-retardant filler, a non-halogen filler is preferable because it has the flame-retardant property and does not emit a toxic gas, and, for example, metal hydroxide can be used. The metal hydroxide decomposes and dehydrates when the flame-retardant semiconductive layer 20 is heated to burn, and the temperature of the flame-retardant semiconductive layer 20 is lowered by the released moisture, so that the burning is suppressed. As the metal hydroxide, for example, magnesium hydroxide, aluminum hydroxide, hydrosulfite, calcium aluminate hydrate, calcium hydroxide, barium hydroxide, etc., and metal hydroxide created by mixing nickel in solid with such a substance can be used. Out of these non-halogen fillers, a single non-halogen filler may be used, or two or more types of the non-halogen fillers may be used in combination.

From the viewpoint of increasing the oxygen index of the flame-retardant semiconductive layer 20 to be larger than 40, as the adding amount of the flame-retardant filler, 150 or more and 250 or less parts by mass of the flame-retardant filler per 100 parts by mass of the resin component is preferable. When the adding amount is less than 150 parts by mass thereof, the desired high flame-retardant property can probably not be obtained in the insulated wire 1. When the adding among is more than 250 parts by mass thereof, the mechanical characteristics of the flame-retardant semiconductive layer 20 probably decreases to decrease the elongation property.

As the conductive filler, for example, carbon black, carbon nanotube, etc., are cited, and the carbon black can be preferably cited. As the carbon black, for example, furnace black, channel black, acetylene black, and thermal black, etc., can be cited, and the acetylene black is particularly preferable.

As the conductive filler, the metal hydroxide can be cited as described above. As the metal hydroxide, for example, magnesium hydroxide, aluminum hydroxide, hydrosulfite, calcium aluminate hydrate, calcium hydroxide, barium hydroxide, etc., and metal hydroxide created by mixing nickel in solid with such a substance can be used. Out of these non-halogen fillers, a single non-halogen filler may be used, or two or more types of the non-halogen fillers may be used in combination.

From the viewpoint of controlling the mechanical characteristics (balance between tensile strength and breaking elongation) of the flame-retardant semiconductive layer 20, it is preferable to perform surface treatment to the conductive filler by using a silane coupling agent, titanate-based coupling agent, fatty acid such as stearic acid, fatty acid salt such as stearate salt, fatty acid metal salt such as calcium stearate, or others.

For the flame-retardant semiconductive layer 20, not only combination use of the conductive filler and the flame-retardant filler but also a flame-retardant/conductive filler which has both the flame-retardant property and the conductivity can be used. As the flame-retardant/conductive filler, for example, metal hydroxide showing weak adhesion to the resin component can be used. As the metal hydroxide, for example, magnesium hydroxide treated with fatty acid, aluminum hydroxide treated with fatty acid, hydrosulfite, calcium aluminate hydrate, calcium hydroxide, barium hydroxide, etc., and metal hydroxide created by mixing nickel in solid with such a substance can be used. For example, "Magseedds N" can be used. Out of these non-halogen fillers, a single non-halogen filler may be used, or two or more types of the non-halogen fillers may be used in combination.

Although there are always no constraints in the following logic, the present inventors have considered that, since using the metal hydroxide with weak adhesion to the resin component results in low volume resistivity of the flame-retardant semiconductive resin composition because of the weak adhesion between the metal hydroxide and the resin, the property as the flame-retardant filler the property as the conductive filler are exhibited. In this manner, the present inventors have found that the flame-retardant semiconductive layer 20 having the oxygen index that is larger than 40, the oxygen index being defined by JIS K7201-2, and having the volume resistivity that is equal to or smaller than $5.0\times10^{15}$ (Ωcm) can be achieved by not only the method of the combination use of the conductive filler and the flame-retardant filler but also the method of use of the metal hydroxide with weak adhesion to the resin component.

When necessary, additives such as other flame retardant, flame retardant promoter, filler, cross-linking agent, cross-linking promoter, plasticizer, metal chelator, softener, reinforcing agent, surfactant, stabilizer, ultraviolet absorber, light stabilizer, lubricant, antioxidant, colorant, processing modifier, inorganic filler, compatibilizer, foaming agent, and antistatic agent may be added to the polymer making up the flame-retardant semiconductive layer 20.

Although not particularly limited, the thickness of the flame-retardant semiconductive layer 20 is, for example, equal to or larger than 0.03 mm and equal to or smaller than 0.30 mm. Note that the flame-retardant semiconductive layer 20 may be cross-linked. For example, the cross-linking may be performed after a cross-linking agent or a cross-linking promoter is added to the resin composition making up the flame-retardant semiconductive layer 20, and then, the resin composition is extruded and formed. Alternatively, the cross-linking may be performed by irradiating the flame-retardant semiconductive layer 20 with electron beams.

(Insulating Layer)

The insulating layer 22 is preferably made of an insulating resin composition whose volume resistivity is equal to or larger than $1.0\times10^{16}$ (Ωcm) to be configured so that a water absorption amount and a water diffusion coefficient are small. The insulating layer 22 has a high water impervious property so that water is difficult to infiltrate therein, and therefore, the water infiltration into the flame-retardant semiconductive layer 20 located inside the insulating layer 22 can be suppressed. Although the insulating layer 22 practically does not contain the non-halogen filler and has therefore a low flame-retardant property, the insulating layer 22 is covered with the flame-retardant layer 24 described later.

A material making up the insulating layer 22 is preferably a material whose volume resistivity is larger than $1.0\times10^{16}$ (Ωcm), and there is no particular upper limit in the volume resistivity. When the volume resistivity is equal to or smaller than $1.0\times10^{16}$ (Ωcm), the insulation resistance is reduced at the time of water absorption in the insulting layer 22, and therefore, the direct-current stability is reduced. In the present specification, note that the volume resistivity is evaluated in conformity to the JIS C2151.

From the viewpoint of ensuring the forming workability of the insulating layer 22, a resin is preferable as the resin component making up the insulating layer 22, and the same resin as that of the flame-retardant semiconductive layer 20 can be used. Polyolefin is more preferable for the insulating layer 22, and high-density polyethylene and/or low-density polyethylene can be used. Among these materials, linear low-density polyethylene (LLDPE) is particularly preferable because of a low moisture absorption rate, favorable formability, relatively large breaking elongation, other excellent properties such as high oil resistance (solvent resistance), and inexpensiveness.

When the insulating layer 22 is made of such a resin as LLDPE, for example, a resin composition containing LLDPE may be formed by its extrusion molding to the outer periphery of the flame-retardant semiconductive layer 20. From the viewpoint of further improving the water impervious property of the insulating layer 22, it is preferable to form the insulating layer 22 from a cross-linked substance by addition and cross-linkage of a cross-linking agent, a cross-linking promoter, etc., to/with the resin composition. Because of the cross-linkage, a molecular structure of the resin becomes rigid, so that the water impervious property of the insulating layer 22 can be improved. Besides, the strength of the insulating layer 22 can be also improved. Therefore, even if the insulating layer 22 is thinned, the high water impervious property can be kept without losing the strength.

It is preferable to cross-link the cross-linked substance making up the insulating layer 22 so that its gel fraction is equal to or larger than 40% and equal to or smaller than 100%. The strength and the water impervious property of the insulating layer 22 can be increased by the high gel fraction of the cross-linked substance, and therefore, the thickness of the insulating layer 22 can be thinned.

In order to cross-link the insulating layer 22, a publicly-known cross-linking agent or cross-linking promoter may be added to the resin composition. As the cross-linking agent, for example, an organic peroxide, a silane coupling agent, etc., can be used. As the cross-linking promoter, for example, a polyfunctional monomer such as triallyl isocyanurate and trimethylol propane triacrylate can be used. An adding amount of such a material is not particularly limited, and can be properly changed so that, for example, the degree of cross-linking of the insulating layer 22 in terms of gel fraction is equal to or larger than 40% and equal to or smaller than 100%. As the cross-linking method, a publicly-known method such as chemical cross-linking and electron beam cross-linking is applicable in accordance with the type of the cross-linking agent.

The insulating layer 22 can contain an additive of equal to or smaller than 5 parts by mass per 100 parts by mass of the resin component. The insulating layer 22 contains preferably the additive being equal to or smaller than 3 parts by mass, and more preferably the additive being equal to or smaller than 1.5 parts by mass.

Here, the additive means an additive such as cross-linking agent, cross-linking promoter, copper inhibitor, flame retardant, flame retardant promoter, plasticizer, filler, metal chelator, softener, reinforcing agent, surfactant, stabilizer, ultraviolet absorber, light stabilizer, lubricant, antioxidant, colorant (e.g., carbon black), processing modifier, inorganic filler, compatibilizer, foaming agent, and antistatic agent.

(Flame-Retardant layer)

The flame-retardant layer 24 is formed by, for example, extruding a flame-retardant resin composition containing a flame-retardant filler onto the outer periphery of the insulating layer 22 so that its oxygen index is larger than 40. The flame-retardant layer 24 is located on the surface layer of the insulated wire, and does not contribute to the direct-current stability but suppresses the decrease in the flame-retardant property of the insulated wire as a whole because of covering the insulating layer 22 having the low flame-retardant property.

The flame-retardant layer 24 is made of a flame-retardant resin composition containing a resin component, and contains a flame-retardant filler when necessary.

A type of the resin component making up the flame-retardant layer 24 may be properly changed in accordance with the characteristics required for the insulated wire 1, such as elongation and strength. For example, a vinyl chloride resin, fluororesin, polyolefin resin such as polyethylene, polyimide, polyether ether ketone (PEEK), etc., can be used.

As the examples of the vinyl chloride resin, a single polymer of vinyl chloride (polyvinyl chloride), copolymer of vinyl chloride and other monomer that can copolymerize (e.g., vinyl chloride-vinyl acetate copolymer), and a mixture of these substances are cited. When necessary, two or more types of vinyl chloride resins that are different in a degree of polymerization may be mixed in combination and used.

As the examples of the fluororesin, tetrafluoroethylene-perfluoroalkylvinylether copolymer (PFA), tetrafluoroethylene-hexafluoropropylene copolymer (FEP), polytetrafluoroethylene (PTFE), ethylene-tetrafluoroethylene copolymer (EFEP), ethylene-tetrafluoroethylene copolymer (ETFE) and others can be used. One type or combination of these substances may be used. Note that at least a part of the fluororesin is preferable to be cross-linked.

As the polyolefin resin, a polyethylene-based resin, a polypropylene-based resin, etc., can be used, and the polyethylene-based resin is particularly preferable. As the polyethylene-based resin, for example, linear low-density polyethylene (LLDPE), low-density polyethylene (LDPE), high-density polyethylene (HDPE), ethylene-(α-olefin) copolymer, ethylene-vinyl acetate copolymer (EVA), ethylene-acrylic acid ester copolymer, and ethylene-propylene-diene copolymer, etc., can be used. Out of these resins, a single resin may be used, or two or more types of the resins may be used together. From the viewpoint of obtaining the higher flame-retardant property in the flame-retardant layer 24, EVA is particularly preferable among the polyolefin-based resins.

When a resin with the high flame-retardant property is used, addition of the flame retardant is optional. When a polyolefin resin is used, it is preferable to add a large amount of a flame-retardant filler in order to increase the oxygen index of the flame-retardant layer 24. When polyimide or PEEK is used, it is not required to add the flame-retardant filler because each of these materials has the high flame-retardant property of the resin itself. The polyolefin has a lower forming temperature than that of the polyimide, etc., so that the formability of the flame-retardant layer 24 is superior thereto, and besides, has a larger breaking elongation than that of the polyimide, etc., so that bendability of the flame-retardant layer 24 is superior thereto.

As the flame-retardant filler, a non-halogen filler is preferable because it has the flame-retardant property and does not emit a toxic gas, and, for example, metal hydroxide can be used. The metal hydroxide decomposes and dehydrates when the flame-retardant layer 24 is heated to burn, and the temperature of the flame-retardant layer 24 is lowered by the released moisture, so that the burning is suppressed. As the metal hydroxide, for example, magnesium hydroxide, aluminum hydroxide, hydrosulfite, calcium aluminate hydrate, calcium hydroxide, barium hydroxide, etc., and metal hydroxide created by mixing nickel in solid with such a substance can be used. Out of these non-halogen fillers, a single non-halogen filler may be used, or two or more types of the non-halogen fillers may be used in combination.

From the viewpoint of controlling the mechanical characteristics (balance between tensile strength and breaking elongation) of the flame-retardant layer 24, it is preferable to perform surface treatment to the flame-retardant filler by using a silane coupling agent, titanate-based coupling agent, fatty acid such as stearic acid, fatty acid salt such as stearate, fatty acid metal salt such as calcium stearate, or others. From the viewpoint of obtaining the conductivity to the flame-retardant layer 24, a metal hydroxide surface-treated with fatty acid such as stearic acid, fatty acid salt such as stearate, fatty acid metal salt such as calcium stearate, or others can be used to provide a function as the flame-retardant/conductive filler, so that the flame-retardant layer 24 can function as the flame-retardant semiconductive layer.

From the viewpoint of increasing the oxygen index of the flame-retardant layer 24 to be larger than 40, as the adding amount of the flame-retardant filler, 150 or more and 250 or less parts by mass of the flame-retardant filler per 100 parts by mass of the resin component is preferable. When the adding amount is less than 150 parts by mass thereof, the desired high flame-retardant property can probably not be obtained in the insulated wire 1. When the adding among is more than 250 parts by mass thereof, the mechanical characteristics of the flame-retardant layer 24 probably decreases to decrease the elongation property.

The flame-retardant layer 24 may be cross-linked as similar to the flame-retardant semiconductive layer 20. For example, the cross-linking of the flame-retardant layer 24 may be performed after a cross-linking agent or a cross-linking promoter is added to the resin composition making up the flame-retardant layer 24, and then, the resin composition is extruded and formed. A cross-linking method is not particularly limited, and the cross-linking may be performed by a related-art publicly-known cross-linking method such as irradiation with electron beams. Note that it is preferable to arrange the flame-retardant layer 24 as the outermost layer of the insulated wire.

(Stacked Structure of Coating Layer)

Subsequently, a stacked structure of the coating layer (the flame-retardant semiconductive layer 20, the insulating layer 22, and the flame-retardant layer 24) will be described.

In the coating layer, each thickness of the flame-retardant semiconductive layer 20 and the flame-retardant layer 24 is not limited, and may be properly changed in accordance with the flame-retardant property and the direct-current stability required for the coating layer. From the viewpoint of obtaining the high flame-retardant property, it is preferable to form the flame-retardant layer 24 whose thickness is equal to or larger than 0.25 mm while the flame-retardant semiconductive layer 20 is formed as thin as possible.

The flame-retardant semiconductive layer 20 contributes to the flame-retardant property and the direct-current stability of the coating layer. From the viewpoint of obtaining the desired direct-current stability, the thickness of the flame-retardant semiconductive layer 20 is preferably at least 0.5 or more times a wire diameter of the metal wire making up the conductor 11. For example, if a conductor diameter is equal to or smaller than 0.20 mm, the thickness is preferably equal to or larger than 0.1 mm. An excessively thin flame-retardant semiconductive layer 20 cannot sufficiently cancel surface irregularity of the conductor 11 caused by the metal wire when the conductor 11 is made by stranding a plurality of metal wires together, and therefore, there is a risk of the formation of the irregularly-surfaced insulating layer 22 on the flame-retardant semiconductive layer 20, which results in decrease in the direct-current stability. Accordingly, the thickness of the flame-retardant semiconductive layer 20 is set to be within the above-described thickness range, so that the flame-retardant semiconductive layer 20 can be flattened to reduce the surface irregularity of the insulating layer 22, and the direct-current stability can be further improved. Meanwhile, its upper limit is not particularly limited, and can be properly changed in consideration of the flame-retardant property of the coating layer and the diameter reduction in the insulated wire 1.

In the coating layer, the thickness of the insulating layer 22 is not particularly limited but is preferably equal to or larger than 0.02 mm and equal to or smaller than 0.50 mm from the viewpoint of the flame-retardant property of the insulated wire 1.

The insulating layer 22 practically contains no non-halogen filler, and therefore, has a risk of the decrease in the flame-retardant property of the insulated wire 1. However, when the thickness of the insulating layer 22 is equal to or smaller than 0.50 mm, the high insulation property can be kept without losing the flame-retardant property of the insulated wire 1.

Since the flame-retardant layer 24 covers the insulating layer 22 to suppress its burning, the thickness of the flame-retardant layer 24 is preferably at least equal to or larger than 0.25 mm. Meanwhile, its upper limit is not particularly limited, and can be properly changed in consideration of the flame-retardant property of the coating layer and the diameter reduction in the insulated wire 1.

The coating layer shown in FIG. 1 according to the embodiment of the present invention is formed of three layers. Meanwhile, the three layers may have a multi-layered structure in which a plurality of the flame-retardant semiconductive layers 20 may be formed on an outer periphery of the conductor 11, a plurality of the insulating layers 22 may be formed on an outer periphery of the flame-retardant semiconductive layer 20, and a plurality of the flame-retardant layers 24 may be formed on the insulating layer 22.

It is only required to form the flame-retardant semiconductive layer 20 on the outer periphery of the conductor 11, the flame-retardant layer 24 as the outermost layer, and the insulating layer 22 between these two layers. There is no problem of existence of a different resin composition layer between the flame-retardant semiconductive layer 20 and the insulating layer 22 and between the insulating layer 22 and the flame-retardant layer 24. For example, a layer exhibiting other characteristics such as an adhesive layer may be arranged between these layers.

Figure 2:
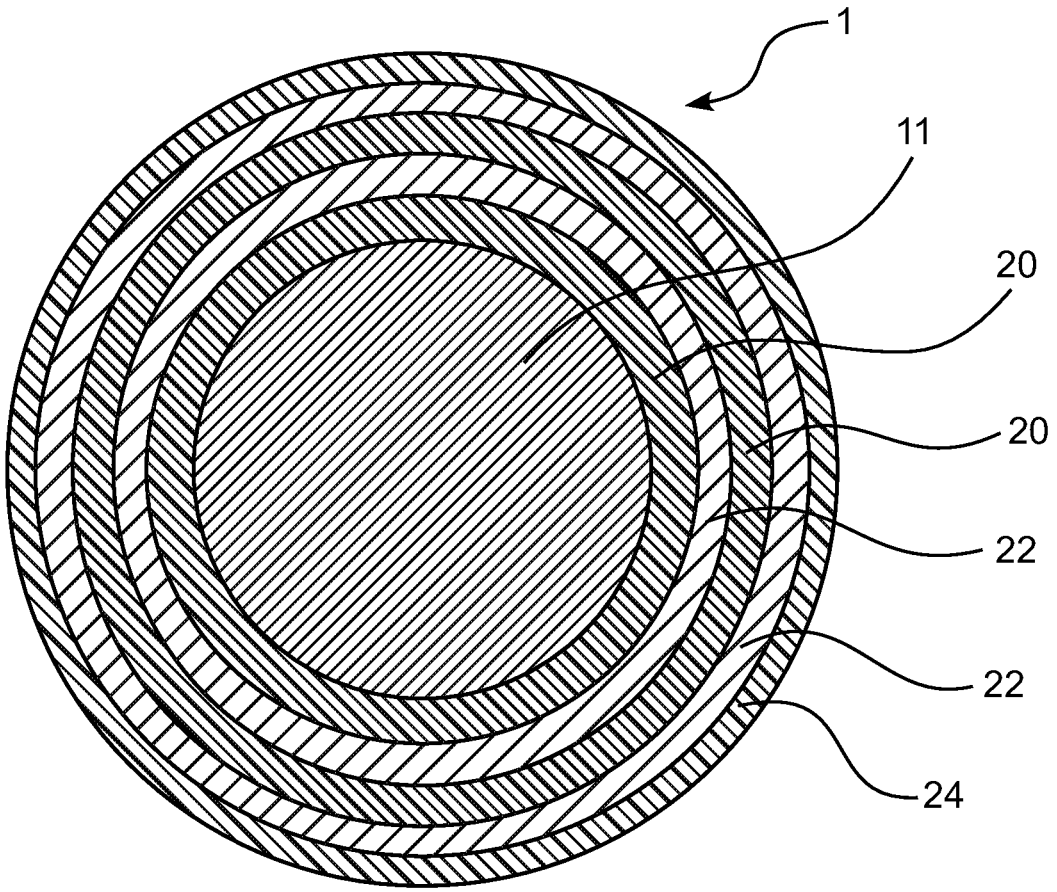
FIG. 2 is a horizontal cross-sectional view showing another embodiment of an insulated wire of the present invention.

As shown in FIG. 2, a plurality of the flame-retardant semiconductive layers 20 and a plurality of insulating layers 22 may be provided so as to form a five-layer structure in which the insulating layers 22 are interposed among the flame-retardant semiconductive layer 20, the flame-retardant semiconductive layer 20, and the flame-retardant layer 24.

Note that the insulated wire of the present embodiment is not particularly limited in its application. However, the insulated wire can be used as, for example, a power system wire (an insulated wire in conformity to Power & Control Cables described in EN 50264-3-1 (2008)).

PRACTICAL EXAMPLES

Next, the present invention will be further described in detail on the basis of practical examples. However, the present invention is not limited by these practical examples.

<Materials Used in Practical Examples and Comparative Examples>

Ethylene-vinyl acetate (EVA) copolymer: "EvaFlex EV170" produced by Du Pont-Mitsui Polychemicals Co., Ltd.

Maleic acid modified polymer: "TAFMAR MH7020" produced by Mitsui Chemicals, Inc.

Thermoplastic polyimide: "AURUM PL450C" produced by Mitsui Chemicals, Inc.

Silicone modified polyetherimide: "STM1500" produced by SABIC Corporation

Linear low-density polyethylene (LLDPE): "EVOLUE SP2030" produced by Prime Polymer Co., Ltd.

Flame-retardant filler (magnesium hydroxide treated with silane): "Magseeds S" produced by Konoshima Chemical Co., Ltd.

Conductive filler (carbon): "Denka black" produced by Denka Co., Ltd.

Flame-retardant/conductive filler (magnesium hydroxide treated with fatty acid): "Magseeds N" produced by Konoshima Chemical Co., Ltd.

Mixed-system antioxidant: "Adekastab A0-18" produced by ADEKA Corporation

Phenolic-system antioxidant: "Irganox1010" produced by BASF SE Corporation

Carbon black: "ASAHI THERMAL" produced by Asahi Carbon Co., Ltd.

Lubricant (zinc stearate)

Cross-linking promoter (trimethylol propane triacrylate (TMPT)): produced by Shin Nakamura Chemical Co., Ltd.

<Preparation of Flame-Retardant Semiconductive Resin Composition> (for Practical Example)

75 parts by mass of the EVA, 25 parts by mass of the maleic acid modified polymer, 150 parts by mass of the magnesium hydroxide treated with fatty acid that is the flame-retardant/conductive filler, 2 parts by mass of the cross-linking promoter, 2 parts by mass of the mixed-system antioxidant, 2 parts by mass of the carbon black, and 1 parts by mass of the lubricant were mixed together, and the mixture was kneaded by using a 75-L pressure kneader. After the kneading, the kneaded mixture was extruded by using an extruder to form a strand, and was cooled in water and cut, so that a pellet flame-retardant semiconductive resin composition was obtained. This pellet had a cylindrical shape having a diameter of about 3 mm and a height of about 5 mm. Note that the oxygen index of the flame-retardant semiconductive resin composition was 41.5. The volume resistivity was $7.8\times10^{14}$ (Ωcm).

<Preparation of Semiconductive Resin Composition> (for Comparison)

75 parts by mass of the EVA, 25 parts by mass of the maleic acid modified polymer, 50 parts by mass of the conductive filler (carbon), 2 parts by mass of the cross-linking promoter, 2 parts by mass of the mixed-system antioxidant, 2 parts by mass of the carbon black, and 1 parts by mass of the lubricant were mixed together, and the mixture was kneaded by using a 75-L pressure kneader. After the kneading, the kneaded mixture was extruded by using an extruder to form a strand, and was cooled in water and cut, so that a pellet semiconductive resin composition was obtained. This pellet had a cylindrical shape having a diameter of about 3 mm and a height of about 5 mm. Note that the oxygen index of the semiconductive resin composition was 24.2. The volume resistivity was $8.2\times10^{3}$ (Ωcm).

<Preparation of Insulating Resin Composition>

Subsequently, to prepare the insulating resin composition for making up the insulating layer, 100 parts by mass of the LLDPE and 1 parts by mass of the phenolic-system antioxidant were dry-blended and kneaded together by using a pressure kneader, so that the insulating resin composition was prepared.

75 parts by mass of the EVA, 25 parts by mass of the maleic acid modified polymer, 150 parts by mass of the magnesium hydroxide (Magseeds S) treated with silane that is the flame-retardant filler, 2 parts by mass of the cross-linking promoter, 2 parts by mass of the mixed-system antioxidant, 2 parts by mass of the carbon black, and 1 parts by mass of the lubricant were mixed together, and the mixture was kneaded by using a 75-L pressure kneader. After the kneading, the kneaded mixture was extruded by using an extruder to form a strand, and was cooled in water and cut, so that a pellet flame-retardant resin composition was obtained. This pellet had a cylindrical shape having a diameter of about 3 mm and a height of about 5 mm. Note that the oxygen index of the flame-retardant resin composition was 45.5.

Production of Insulated Wire

First Practical Example

The insulated wire was produced by using the above-described flame-retardant semiconductive resin composition, flame-retardant resin composition and insulating resin composition. Specifically, the insulated wire of a first practical example was produced by three-layer co-extrusion of the flame-retardant semiconductive resin composition, the insulating resin composition, and the flame-retardant resin composition each of which has a predetermined thickness onto an outer periphery of a tin-plated copper conductor wire having an outer diameter of 1.25 mm, and then, by cross-linkage of each composition with such irradiation with electron beam as causing an absorbed dose of 75 kGy. In the produced insulated wire, the flame-retardant semiconductive layer having the thickness of 0.10 mm, the insulating layer having the thickness of 0.10 mm, and the flame-retardant layer having the thickness of 0.30 mm were formed in this order from the conductor side so that an insulated-wire outer diameter was 2.25 mm. The thickness of the coating layer was 0.50 mm.

As each layer thickness, an average obtained by separating a sample having a length of 1 m into 10 segments and observing and measuring each cross section of these segments by using a microscope was employed.

The three-layer co-extrusion was executed by using three single-screw extruders and combining the resin compositions in a crosshead.

<Characteristic Evaluation>

The produced insulated wire was evaluated in the mechanical strength, the direct-current stability, the flame-retardant property and the diameter reduction under the following method.

(Mechanical Strength)

For the mechanical strength, the breaking elongation under the tensile test was evaluated on the basis of EN50264, 60811-1-2. Specifically, the tensile test with a tension rate of 200 m/min was executed to a cylindrical sample that was obtained by pulling out the conductor from the insulated wire. When the breaking elongation was equal to or larger than 150%, its result was evaluated as "○". When the breaking elongation was smaller than 150%, its result was evaluated as "X".

(Direct-Current Stability)

The direct-current stability was evaluated under the direct-current stability test in conformity to EN50305.6.7. Specifically, after the insulated wire was immersed in a 3% NaCl aqueous solution at 85° C. and applied with a voltage of 1500 V, when the electrical breakdown did not occur even after the elapse of 240 hours or longer, its result was evaluated as "pass (○)" indicating excellent electrical characteristics. When the electrical breakdown occurred within less than the elapse of 240 hours, its result was evaluated as "fail (X)".

(Flame-Retardant Property)

For the flame-retardant property, the vertical tray flame test (VTFT) was executed on the basis of EN50266-2-4. Specifically, seven electrical wires each having an entire length of 3.5 m were stranded to produce one bunch stranded wire, eleven bunch wires were vertically arranged with equal intervals and were burned for 20 minutes, and then, were self-extinguished. Then, its char length was targeted to be equal to or shorter than 2.5 m from the lower end. When the char length was equal to or shorter than 2.5 m, its result was evaluated as "pass (○)". When the char length was longer than 2.5 m, its result was evaluated as "fail (X)".

(Diameter Reduction)

In comparison with data of Conductor diameter and Mean thickness of insulation shown in "Table 1"—"General data"—"Cable type 0.6/1 kV unsheathed" in EN50264-3-1 (2008), when the thickness of the coating layer was larger than the outer diameter of the conductor, its result was evaluated as "fail (X)". When the thickness of the coating layer was smaller than the outer diameter of the conductor, its result was evaluated as "pass (○)".

Second and Third Practical Examples

In the second and third practical examples, the insulated wire was produced as similar to the first practical example except that the outer diameter of the tin-plated copper conductor wire and the thicknesses of the flame-retardant semiconductive layer, the insulating layer and the flame-retardant layer were changed as described in a table 1.

Results of the characteristic evaluations in the first to third practical examples are collectively shown in the table 1.

TABLE 1

| | | First practical example | Second practical example | Third practical example |
|---|---|---|---|---|
| Conductor | Outer diameter (mm) | 1.25 | 1.46 | 1.97 |
| Flame-retardant semiconductive layer (flame-retardant semiconductive resin composition) | Thickness (mm) | 0.10 | 0.11 | 0.11 |
| Insulating layer (insulating resin composition) | Thickness (mm) | 0.10 | 0.12 | 0.12 |
| Flame-retardant layer (flame-retardant resin composition) | Thickness (mm) | 0.30 | 0.35 | 0.35 |
| Coating layer | Thickness (mm) | 0.50 | 0.58 | 0.58 |
| Insulated wire | Outer diameter (mm) | 2.25 | 2.62 | 3.13 |
| Characteristic evaluation result | Mechanical strength | ○ | ○ | ○ |
| | Direct-current stability | ○ | ○ | ○ |
| | Flame-retardant property | ○ | ○ | ○ |
| | Diameter reduction | ○ | ○ | ○ |

It was confirmed that all the first to third practical examples had the sufficient mechanical strength, direct-current stability and flame-retardant property.

While the outer diameter of the conductor was 1.25 mm and the thickness of the coating layer was 0.50 to 0.58 mm in the practical examples, the outer diameter of the conductor is 1.25 mm and the thickness of the coating layer is 0.6 mm in Table 1 of EN50264-3-1 described above. Therefore, in comparison between both thicknesses of the coating layers, the practical examples passed (○) in the diameter reduction because the thickness of the coating layer was smaller than the outer diameter of the conductor.

First to Fifth Comparative Examples

In the first to fifth comparative examples, the insulated wire was produced as similar to the first practical example except that the semiconductive resin composition was used as the semiconductive layer, and that the thicknesses of the insulating layer and the flame-retardant layer were changed to thicknesses described in a table 2. Results of the characteristic evaluations are collectively shown in the table 2.

The first to third comparative examples passed (○) in the mechanical strength and the direct-current stability but failed (X) in the flame-retardant property.

Although the flame-retardant semiconductive layer of the first practical example was not used and the thickness of the insulating layer was twice the length in the first practical example, the fourth comparative example failed (X) in the mechanical strength and the flame retardant property.

Although the insulating layer of the first practical example was not used and the thickness of the flame-retardant layer was 0.4 mm, the fifth comparative example failed (X) in the mechanical strength and the direct-current stability property.

TABLE 2

| | | First comparative example | Second comparative example | Third comparative example |
|---|---|---|---|---|
| Conductor | Outer diameter (mm) | 1.25 | 1.46 | 1.97 |
| Semiconductive layer (semiconductive resin composition) | Thickness (mm) | 0.10 | 0.11 | 0.11 |
| Insulating layer (insulating resin composition) | Thickness (mm) | 0.10 | 0.12 | 0.12 |
| Flame-retardant layer (flame-retardant resin composition) | Thickness (mm) | 0.30 | 0.35 | 0.35 |
| Coating layer | Thickness (mm) | 0.50 | 0.58 | 0.58 |
| Insulated wire | Outer diameter (mm) | 2.25 | 2.62 | 3.13 |
| Characteristic evaluation result | Mechanical strength | ○ | ○ | ○ |
| | Direct-current stability | ○ | ○ | ○ |
| | Flame-retardant property | X | X | X |
| | Diameter reduction | ○ | ○ | ○ |

| | | Fourth comparative example | Fifth comparative example |
|---|---|---|---|
| Conductor | Outer diameter (mm) | 1.25 | 1.25 |
| Semiconductive layer (semiconductive resin composition) | Thickness (mm) | — | 0.10 |
| Insulating layer (insulating resin composition) | Thickness (mm) | 0.20 | — |
| Flame-retardant layer (flame-retardant resin composition) | Thickness (mm) | 0.30 | 0.40 |
| Coating layer | Thickness (mm) | 0.50 | 0.50 |
| Insulated wire | Outer diameter (mm) | 2.25 | 2.25 |
| Characteristic evaluation result | Mechanical strength | X | X |
| | Direct-current stability | ○ | X |
| | Flame-retardant property | X | ○ |
| | Diameter reduction | ○ | ○ |

What is claimed is:

1. An insulated wire comprising:

a conductor;

a flame-retardant semiconductive layer arranged immediately on the conductor;

an insulating layer arranged on an outer periphery of the flame-retardant semiconductive layer; and a flame-retardant layer arranged on an outer periphery of the insulating layer, wherein an oxygen index of the flame-retardant semiconductive layer defined by JIS K7201-2 is larger than 40, a volume resistivity of the flame-retardant semiconductive layer defined by JIS C2151 is equal to or smaller than $5.0\times10^{15}$ (Ωcm), the flame-retardant semiconductive layer contains a resin component and a non-halogen filler so as to contain 150 or more and 250 or less parts by mass of the non-halogen filler per 100 parts by mass of the resin component, and the insulating layer contains an additive in an amount that is less than or equal to 5 parts by mass per 100 parts by mass of the resin component.

2. The insulated wire according to claim 1, wherein a diameter of the conductor is equal to or smaller than 1.25 mm, and a total of the thicknesses of the flame-retardant semiconductive layer, the insulating layer, and the flame-retardant layer is smaller than 0.6 mm.

3. The insulated wire according to claim 1, wherein a diameter of the conductor is larger than 1.25 mm and equal to or smaller than 5.0 mm, and a total of the thicknesses of the flame-retardant semiconductive layer, the insulating layer, and the flame-retardant layer is smaller than 0.7 mm.

4. The insulated wire according to claim 1, wherein the insulated wire has a flame-retardant property that allows the insulated wire to pass a vertical tray flame test (VTFT) on the basis of EN 50266-2-4.

5. The insulated wire according to claim 1, wherein the insulated wire has a direct-current stability that allows the insulated wire to pass a direct-current stability test in conformity to EN 50305.6.7.

6. The insulated wire according to claim 1, wherein a volume resistivity of the insulating layer defined by JIS C2151 is larger than $1.0\times10^{16}$ (•cm).

7. The insulated wire according to claim 1, wherein an oxygen index of the flame-retardant layer is larger than 40.

8. The insulated wire according to claim 1, wherein the flame-retardant semiconductive layer includes at least one resin selected from a group consisting of high-density polyethylene, linear low-density polyethylene, low-density polyethylene, ethylene-(a-olefin) copolymer, ethylene-vinyl acetate copolymer, ethylene-acrylic acid ester copolymer, and ethylene-propylene-diene copolymer.

9. The insulated wire according to claim 1, wherein the flame-retardant layer includes at least one resin selected from a group consisting of high-density polyethylene, linear low-density polyethylene, low-density polyethylene, ethylene-(a-olefin) copolymer, ethylene-vinyl acetate copolymer, ethylene-acrylic acid ester copolymer, and ethylene-propylene-diene copolymer.

10. The insulated wire according to claim 1, wherein at least a part of the insulating layer is a cross-linked substance.

11. The insulated wire according to claim 1, wherein a resin composition making up the insulating layer contains a resin component, and the resin component is made of high-density polyethylene and/or low-density polyethylene.

12. The insulated wire according to claim 1, wherein the non-halogen filler is made of metallic hydroxide.

13. The insulated wire according to claim 1, wherein the insulating layer is a cross-linked substance whose gel fraction is equal to or larger than 40% and equal to or smaller than 100%.

* * * * *